United States Patent [19]

Garner et al.

[11] 4,068,731

[45] Jan. 17, 1978

[54] EXTENDED NOZZLE AND BIT STABILIZER AND METHOD OF PRODUCING

[75] Inventors: Lloyd L. Garner, San Clemente; Charles Richard Harris, Whittier, both of Calif.

[73] Assignee: Smith International, Inc., Newport Beach, Calif.

[21] Appl. No.: 742,590

[22] Filed: Nov. 17, 1976

[51] Int. Cl.[2] ..... E21B 9/10

[52] U.S. Cl. ..... 175/339; 175/325; 175/408

[58] Field of Search ..... 175/339, 340, 325, 393, 175/408

[56] References Cited

U.S. PATENT DOCUMENTS

| | | | |
|---|---|---|---|
| 3,207,241 | 9/1965 | Neilson | 175/340 |
| 3,628,616 | 12/1971 | Neilson | 175/408 |
| 3,645,346 | 2/1972 | Miller | 175/393 |

FOREIGN PATENT DOCUMENTS

| | | | |
|---|---|---|---|
| 1,023,419 | 3/1966 | United Kingdom | 175/339 |

*Primary Examiner*—Ernest R. Purser
*Assistant Examiner*—William F. Pate, III

[57] ABSTRACT

A rotary drill bit with downwardly extended circulation nozzle means an outwardly facing portion of which serves as a bit stabilizer wherein the upper portion of the nozzle means is on a greater diameter than the lower portion thereof so that the lower portion is inset from the wall of the formation, the upper portion of the nozzle means being machined from a given larger diameter to a diameter approximately but preferably slightly less than that of the bit body, and providing in the machine surface hardened inserts such as tungsten carbide.

4 Claims, 4 Drawing Figures

Fig. 3.
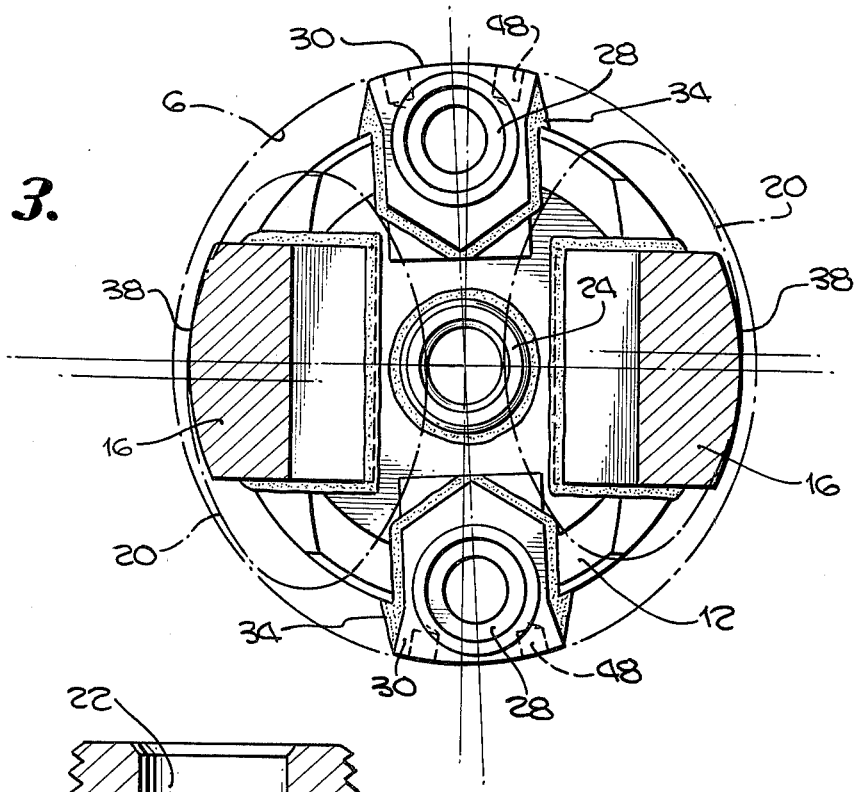
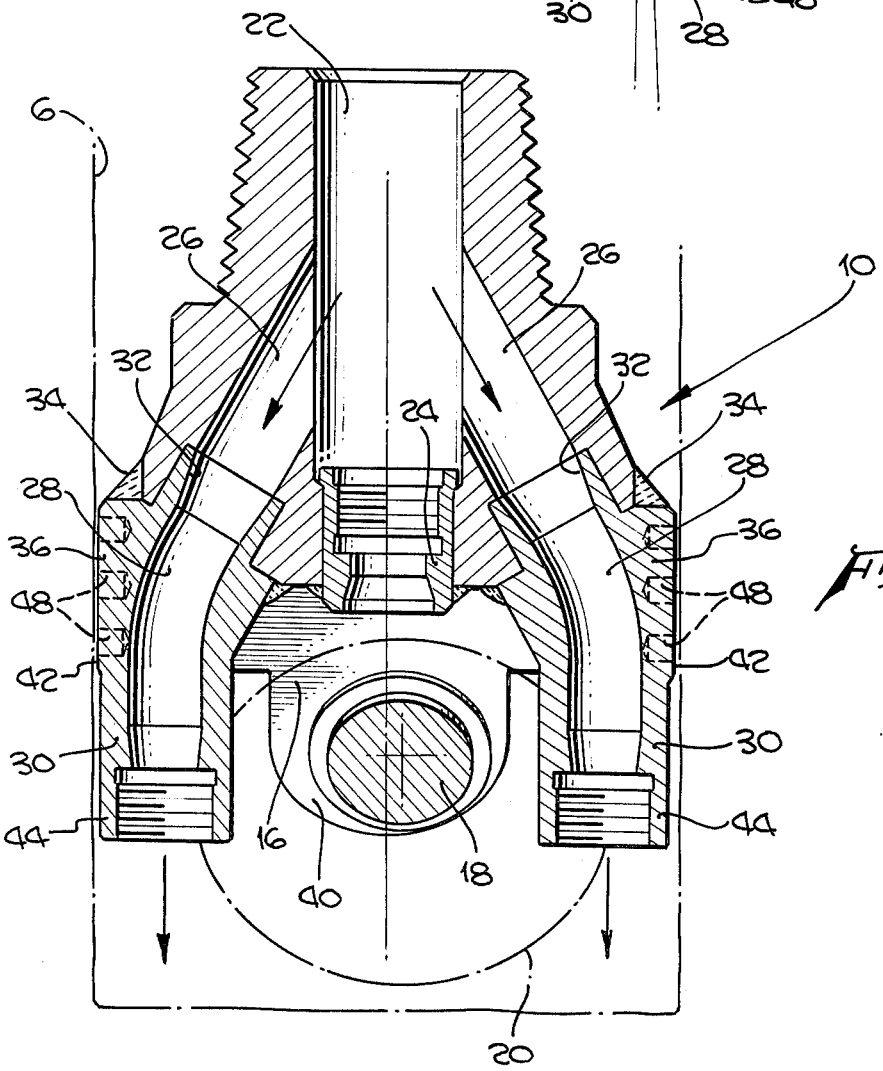
Fig. 4.

EXTENDED NOZZLE AND BIT STABILIZER AND METHOD OF PRODUCING

FIELD OF INVENTION

Drill bits of my invention are intended for use in connection with rotary cone rock bits used in drilling for oil. In the drilling operation, as the bit rotates and the cutters on the bottom thereof rotate in the hole and relative to the bit, parts of the rock formation are cut or broken away. Drilling mud is circulated down through the drill stem and the body of the bit and directed against bottom hole formation and the cutters to clear the cutter teeth and to pick up cuttings from the formation and circulate them upwardly around the drill stem to the surface.

It has been found advantageous to extend circulation nozzles for the drilling mud downwardly close to the bottom of the hole being drilled in the formation to provide better scarifying and suspension of the formation particles in the mud for circulation upwardly and removal from the hole.

Previous extended nozzles have been designed with sufficient clearance in the hole to accommodate any eccentricity in the drill bit assembly and prevent damage to the downwardly extended nozzles which otherwise might come into contact with the formation in the side wall of the hole. Hard surfacing in the form of weld metal has been applied to the nozzles to protect them from undue wear and damage.

The present invention contemplates the provision of circulation nozzles which extend downwardly from the lower portion of the bit body wherein the upper portions of the nozzles are initially formed on a diameter greater than that of the bit body, then those upper portions are turned by machine to a diameter no smaller than and preferably slightly more than that of the bit body. Then this machined surface is provided with hardened inserts such as tungsten carbide which are flush with the machine surface. This provides a wear resisting surface which stabilizes the drill bit in its rotation to assist in maintaining the desired line or direction of drilling. Below these stabilizing portions of the nozzles, they are set in slightly so they will not come in contact with the formation.

The above and objects of the invention will more fully appear from the following description of the invention with the accompanying drawing.

FIG. 3 is a section taken approximately on the line 3—3 of FIG. 2; and

FIG. 4 is a vertical sectional view downwardly through the bit and the circulation passages therein and in the extended nozzles.

Figure 1:
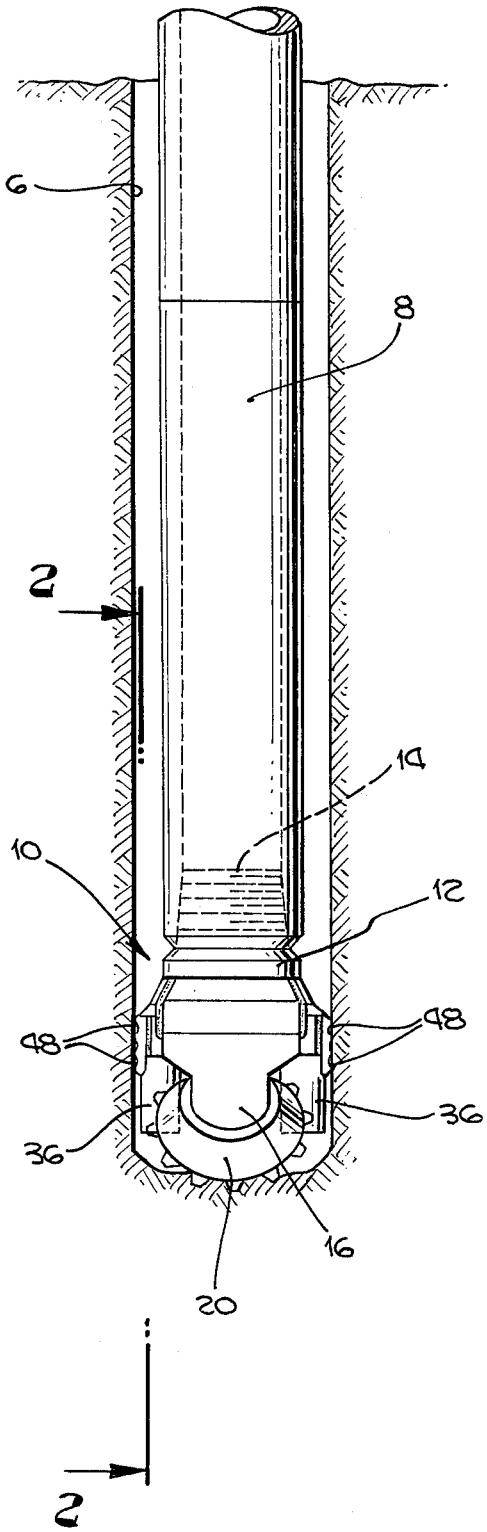
FIG. 1 is a vertical sectional view showing a hole in a formation being drilled with the lower portion of a drill stem and an embodiment of the invention in said elevation.

In FIG. 1 there is shown a well hole 6 in which is the lower section 8 of a string of drill pipe. Secured to the lower end of the drill stem is a drill bit indicated generally at 10. The bit has a body 12 with a tapered and threaded upper end 14 of conventional form for securing to the drill pipe. Extending downwardly as integral parts of the bit body are journal legs 16 having journals 18 upon which are rotatably mounted cone cutters 20 of conventional form.

A drilling mud circulation bore 22 extends downwardly through the bit body 12 to a conventional central mud circulation nozzle 24. Branch conduits 26 communicate with drilling mud circulation conduits 28 in circulation nozzles 30 which have reduced upper ends 32 received in suitable bores in the bit body and are held in place by suitable weld 34.

The upper portions 36 of the downwardly extended nozzles 30 are initially formed on a diameter slightly greater than the diameter defined by outwardly facing surfaces 38 on the lower shirttail portions 40 of the journal arms 16.

Then the outwardly facing surfaces 42 of the upper portions of the extended circulation nozzle 30 are turned or otherwise machined to a diameter slightly more than that defined by the outwardly facing surfaces 38 on the journal legs 16. As shown in FIG. 4 the diameter defined by the machined surfaces 42 of the upper portions of the nozzles is greater than that of the outer surfaces 44 of the lower nozzle portions 46.

The machined nozzle surfaces 42 are then bored inwardly to receive hardened inserts 48 which preferably are of a material such as tungsten carbide.

The machined surfaces 42 comprise part of a cylinder of revolution. The diameter defined by them preferably is slightly more than the diameter defined at 38 at the bottoms of the shirttails 40 on the bit body. However, it is within the contemplation of the invention that the diameter at the nozzle surface 42 be approximately that of the shirttail portions 38, or in other words the O D of the bit body. From another standpoint it might be considered that the diameter at the nozzle surfaces 42 be slightly less than the gage of the bit, which is comparable to the theoretical diameter of the bore hole 6. This in turn is determined by the cutting diameter of the bit 10.

Inasmuch as the drill bit 10 has its body 12 formed by a casting with a rather rough exerior, and in further view of the fact that some drill bits are cast in sections and welded together, plus the fact that the circulation nozzles are welded to the bit body, a certain degree of eccentricity of the tool is quite common. However, by making the extended nozzles oversized laterally and machining them to a rather precise diameter, the nozzle surfaces 42 stabilize the rotational axis of the bit and insure proper direction of drilling action and maintain the more extended lower portions 46 of the circulation nozzles safely out of contact with the side walls of the bore hole 6 so that the nozzles are not damaged. When the drill string and drill bit are subjected to loads upwards of 40,000 pounds it can readily be seen that even rather slight contact of the nozzle ends with the side wall of the hole can easily break off the nozzles and seriously reduce their effective function.

Figure 2:
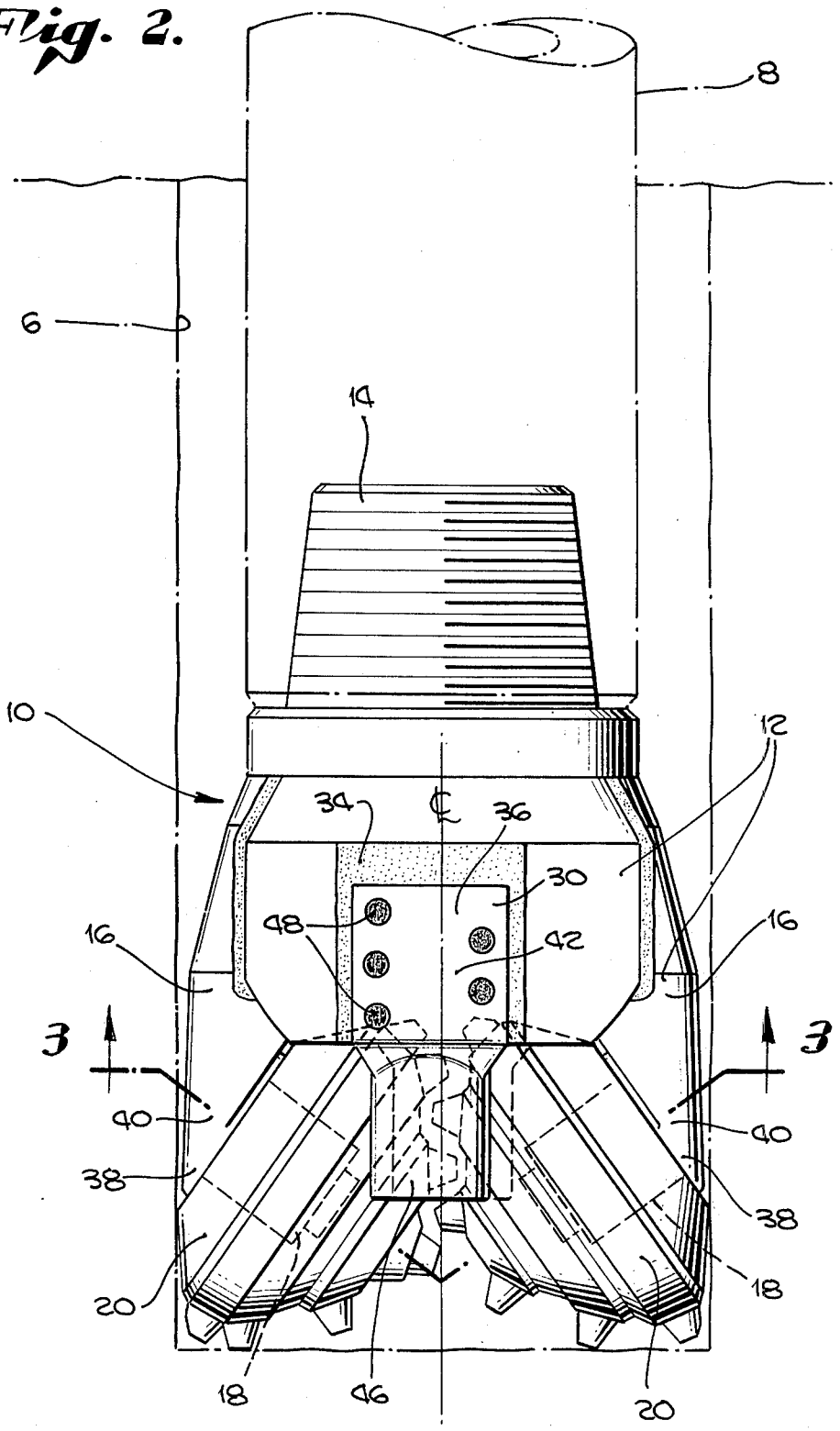
FIG. 2 is an enlarged side elevational view taken approximately on the line 2—2 of FIG. 1 with the formation wall and drill stem in broken lines and with the interior cutter and nozzle portions in broken lines.

It will be noted in FIG. 2 that the lower portion of the machined nozzle surface 42 extends down to and a little below the upwardly disposed portions of the rotary cone cutters 20. This brings the drill stabilizing surfaces 42 down into intimate relationship with the cutters so that the stabilizing and guiding effect of surfaces 42 is quite beneficial.

The above described method of producing the drill bit is quite advantageous in producing a tool which will produce the avantageous results set forth. By making the tool diameter oversized at the upper portions 36 of the nozzle extensions 30 and then turning or otherwise machining those portions to a predetermined diameter on a true circle and then mounting the tungsten carbide inserts 48 in the upper nozzle portions with their outer ends flush with the surface 42, there is provided a highly effective stabilizing means for properly directing the cutters and for maintaining the nozzle extensions in safe and properly functioning conditions closely adjacent the bottom of the hole.

While it is preferred that the outwardly facing upper nozzle portions 42 be on a diameter slightly greater than that of the bit body including the journal legs 16, it should be understood that the nozzle face diameter could be equal to that of the bit or slightly less and still come within the invention concept.

It should be understood that various changes can be made in the form, details, arrangement and proportions of the various parts and in the specific steps of the method without departing from the spirit of the invention.

What is claimed is:

1. In a drill bit having a rotary body with a longitudinal axis of rotation, a drilling fluid supply passage, cutter means supported by and disposed below the body, and of a given gage, a drilling fluid nozzle having an upper portion supported by the body in flow communication with the drilling fluid supply passage and having a downwardly extending free lower portion with a drilling fluid outlet, the upper portion of said nozzle having a radially outer portion comprising a wear-resisting, bit stabilizing surface on a circle approximating the diameter of the bit, and the lower portion of said nozzle having a radially outer portion lying within a circle concentric to and of less diameter than that of said upper nozzle portion to protect said lower portion from wear and shock from the wall of a hole being drilled.

2. The structure in claim 1, and the circle on which the stabilizing surface lies, being substantially on gage.

3. The structure of claim 1, and said bit stabilizing surface having at least a portion thereof of hard metal.

4. The structure of claim 1, and the support for said cutter means comprising a journal leg extending downwardly from the body with a rotary cone cutter journal thereon, said journal leg having a radially outer portion on approximately the same circle as that of said stabilizing surface of said upper portion of said nozzle.

* * * * *